US009737982B2

(12) United States Patent
Danhash et al.

(10) Patent No.: US 9,737,982 B2
(45) Date of Patent: Aug. 22, 2017

(54) PINNED HEAD SWAGE TOOL

(71) Applicant: DMC Power, Inc., Carson, CA (US)

(72) Inventors: May Danhash, Sherman Oaks, CA (US); Luis Arturo Chavez, Los Angeles, CA (US); Jeffrey Adam Loyd Ackermann, Norco, CA (US)

(73) Assignee: DMC POWER, INC., Carson, CA (US)

( * ) Notice: Subject to any disclaimer, the term of this patent is extended or adjusted under 35 U.S.C. 154(b) by 493 days.

(21) Appl. No.: 13/776,273

(22) Filed: Feb. 25, 2013

(65) Prior Publication Data

US 2014/0237797 A1 Aug. 28, 2014

(51) Int. Cl.

| | |
|---|---|
| ***B21D 39/04*** | (2006.01) |
| ***B25B 27/10*** | (2006.01) |
| ***H01R 43/042*** | (2006.01) |

(52) U.S. Cl.

CPC ..... *B25B 27/10* (2013.01); *B21D 39/048* (2013.01); *H01R 43/0427* (2013.01); *Y10T 29/49826* (2015.01); *Y10T 29/5367* (2015.01)

(58) Field of Classification Search

CPC ..... B21D 39/04; B21D 39/048; B21D 37/04; H01R 43/042; H01R 43/0427; H01R 43/048; Y10T 29/49826; B25B 27/10

USPC ..... 72/409.19, 413, 416, 481.3–481.9, 72/489.92; 29/469

See application file for complete search history.

(56) References Cited

U.S. PATENT DOCUMENTS

| | | | | |
|---|---|---|---|---|
| 3,771,343 | A * | 11/1973 | Dawson | B21D 39/046 29/237 |
| 4,261,194 | A * | 4/1981 | Stephens | H01R 43/042 72/402 |
| 4,292,833 | A * | 10/1981 | Lapp | H02G 1/00 72/409.01 |
| 5,069,058 | A | 12/1991 | Hyatt | 72/413 |
| 5,353,623 | A * | 10/1994 | Bobenhausen | B21D 39/048 29/237 |
| 5,720,197 | A * | 2/1998 | Grau et al. | 72/402 |
| 6,324,884 | B1 * | 12/2001 | Barjesteh et al. | 72/402 |
| 6,484,552 | B1 * | 11/2002 | Bernas | B21D 39/048 29/237 |
| 6,769,283 | B2 * | 8/2004 | Suresh | B21D 39/046 29/237 |
| 6,792,789 | B1 * | 9/2004 | Faucher | 72/456 |
| 7,299,674 | B2 | 11/2007 | Palejwala et al. | 72/402 |
| 7,578,159 | B2 * | 8/2009 | Bowles | B21D 39/048 72/409.01 |
| 8,074,485 | B2 * | 12/2011 | College | B23D 29/00 100/266 |

(Continued)

OTHER PUBLICATIONS

International search report dated Jun. 6, 2014 issued in corresponding PCT application PCT/US2014/017699.

*Primary Examiner* — Edward Tolan
(74) *Attorney, Agent, or Firm* — Norton Rose Fulbright US LLP

(57) ABSTRACT

A swage tool includes a first die coupled to a portion of a head and a second die coupled to a portion of a die block. A die block holder holds the die block and the second die. A piston inside a cylinder moves the second die toward the first die. At least two pins couple the head to the die block holder. When one of the pins is coupled to the head and to the die block holder, the head rotates about an axis transverse to a longitudinal axis of the cylinder.

10 Claims, 7 Drawing Sheets

(56) References Cited

U.S. PATENT DOCUMENTS

| | | | | |
|---|---|---|---|---|
| 8,336,177 | B2 * | 12/2012 | Vernasca | B21D 39/048<br>29/235 |
| 9,085,023 | B2 * | 7/2015 | Danhash | B21D 39/04 |
| 2006/0248939 | A1 * | 11/2006 | Palejwala et al. | 72/416 |

* cited by examiner

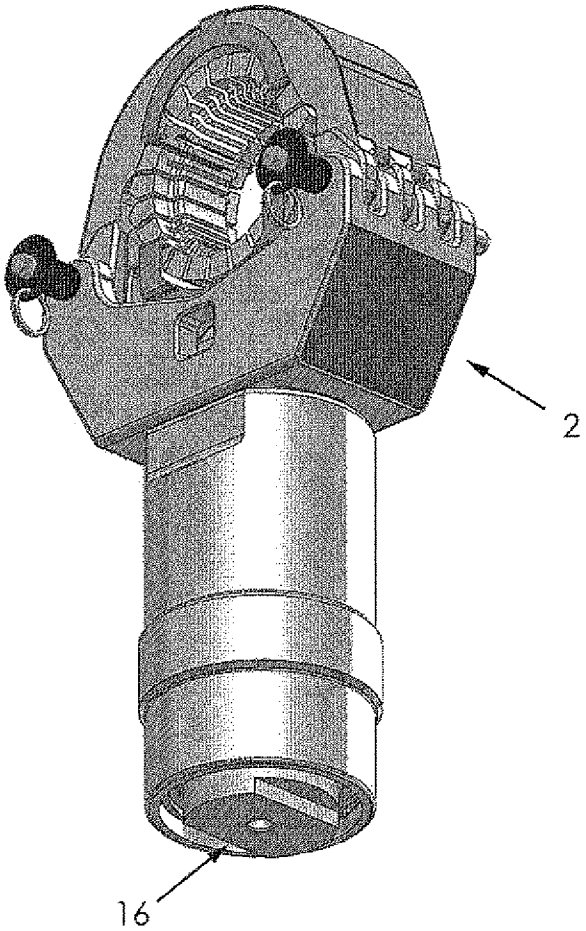
Fig. 4a
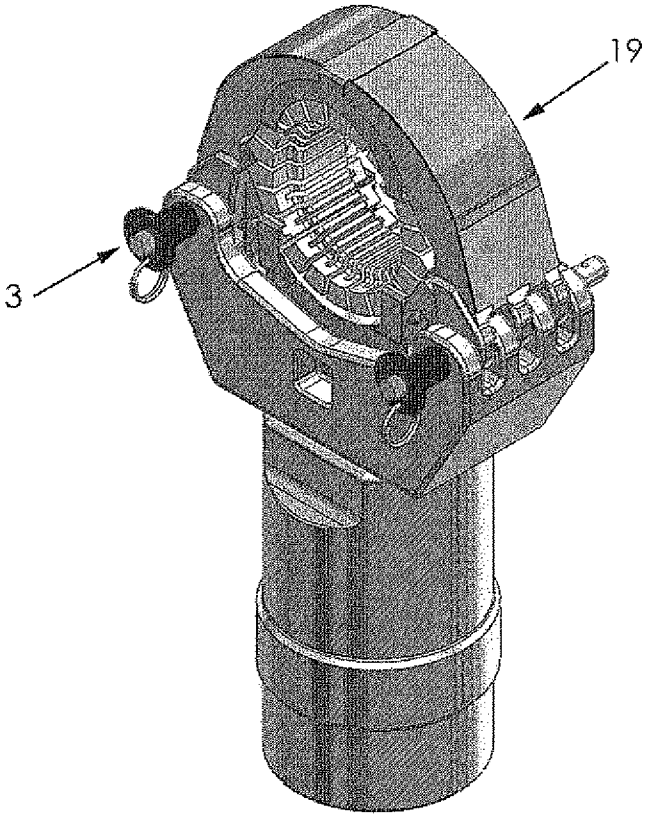

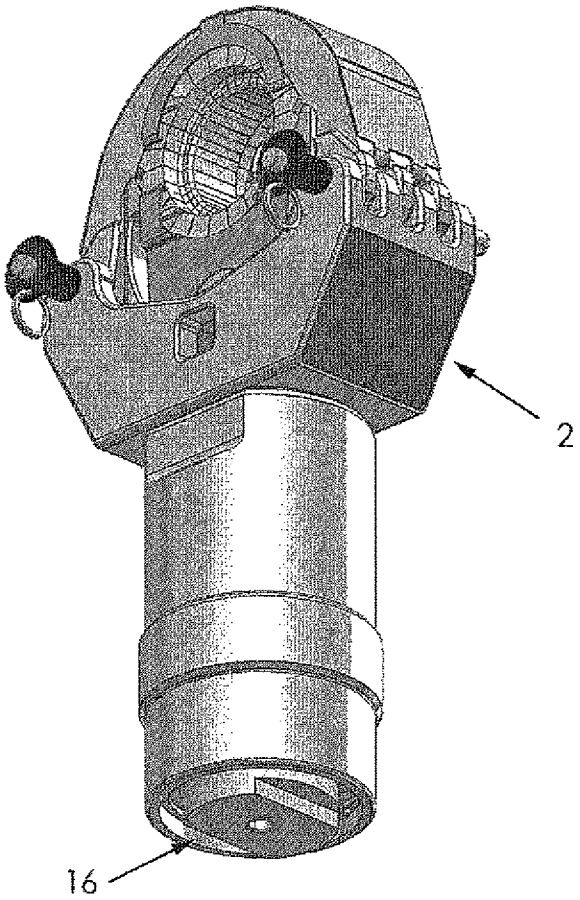
Fig. 4b
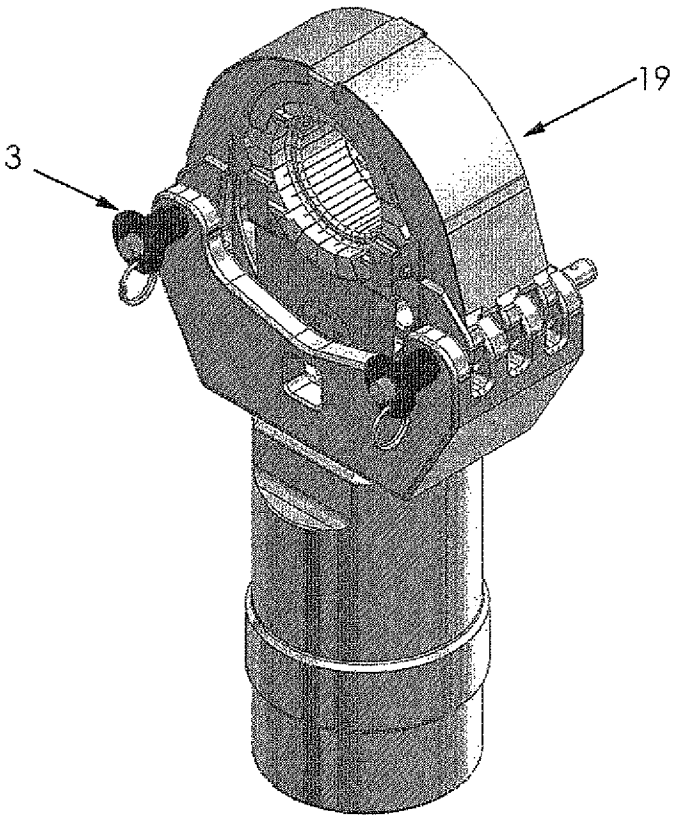

PINNED HEAD SWAGE TOOL

BACKGROUND OF THE INVENTION

Field of the Invention

This invention relates to a swage tool and a method of assembly thereof.

Description of Related Art

Swaged fittings for use in connecting tubes in hydraulic systems are known. For example, tubes are inserted into a fitting, such as a cylindrical sleeve, and the fitting is swaged with a swage tool to produce a fluid-tight connection between the tubes. When swaged by a swage tool, the fitting is compressed radially inward. Annular indentations are thus formed in the tube and fitting to secure the tubes together. In a prior art swage tool, such as disclosed in U.S. Pat. No. 5,069,058, head 60 of swaging tool 10 is slideably attached and removed from cylinder 53 by a tongue and groove configuration on the head and cylinder, respectively. U.S. Pat. No. 7,299,674 provides a similar configuration. Over time, the vibration between the head and the cylinder during swaging will wear down the swage tool, reduce performance and require replacement, especially at the location where the tongues fit within the grooves to connect the head to the cylinder. In particular, because of the slight clearance between the mating surfaces of the tongues and grooves that allow relative sliding movement for assembly, those surfaces will become roughened over time. Consequently, there is also a tendency for the lower die to rotate and wobble during swaging operations. Die rotation or wobble can damage the swaging tool and result in a defectively swaged fitting. Thus, conventional swage tools can become unreliable.

The prior art suffers from the problem that repeated use of the swaging tool causes the tool to wear, especially at a location where the tongues fit the groove. Over time, the surfaces become roughened to the point where either one or both of the head and cylinder portions needs to be replaced entirely.

SUMMARY OF THE INVENTION

The present invention provides a swage tool that is quickly and easily assembled and operated by any user. The invention is preferably used in aerospace and electrical power applications, but is not limited to these fields and may be utilized for any type of swaging. The inventive swage tool also improves reliability and requires less manpower. In one non-limiting example, the invention is used in electrical power substations to swage aluminum or copper connectors onto a cable or electrical bus.

One embodiment of the invention is a swage tool that includes a first die coupled to a portion of a head and a second die coupled to a portion of a die block. A die block holder holds the die block and the second die. A piston inside a cylinder moves the second die toward the first die. At least two pins couple the head to the die block holder. When one of the pins is coupled to the head and to the die block holder, the head rotates about an axis transverse to a longitudinal axis of the cylinder. The pins are slidably inserted though a sawtooth portion of the head and a sawtooth portion of the die block holder. The sawtooth portion of the head interlocks with the sawtooth portion of the die block holder. The cylinder includes a piston coupled to the die block. A first clip retains the first die to the head. A second clip retains the second die to the die block.

A second embodiment of the invention is a swage tool including a first die coupled to a portion of a head and a second die coupled to a portion of a die block. A die block holder holds the die block and the second die. A piston inside a cylinder moves the second die toward the first die. The die block includes a connecting portion coupled to the cylinder. The connecting portion includes a set of pins that are moved between an open position that allows insertion of the cylinder into the die block and a closed position that secures the inserted cylinder within the die block. The cylinder includes a first piston that engages the die block and that is coupled to the connecting portion. The connecting portion includes a spring and is provided on a side of the die block opposite the second die. The cylinder is secured between the set of pins in the closed position In another embodiment of the invention, a method of assembling a swage tool includes a steps of coupling a first die to a head and a second die to a die block. The die block is placed on a die block holder and a cylinder is coupled to the die block. A first pin is slid through the head and the die block holder to couple the head to the die block holder. The head is then rotated about an axis transverse to a longitudinal axis of the cylinder. A second pin is then slid through the head and the die block holder opposite from the first pin. A first clip couples the first die to the head and a second clip couples the second die to the die block. The head is secured to the die block holder after sliding the first and second pins. A piston within the cylinder is coupled to the die block.

In yet another embodiment of the invention, a method of assembling a swage tool includes the steps of coupling a first die to a head, coupling a second die to a die block and coupling the head to a die block holder. A cylinder is coupled to the die block by: pressing in a connecting portion of the die block into an open position; maintaining the open position while inserting the cylinder into the die block; and releasing the connecting portion into a closed position that secures the cylinder within the die block. A set of pins of the connecting portion are moved between the open and closed positions. The open position allows insertion of the cylinder into the die block and the closed position secures the inserted cylinder within the die block. The cylinder includes a first piston that engages the die block and that is coupled to the connecting portion. The connecting portion includes a spring and is provided on a side of the die block holder opposite the second die. The cylinder is secured between the set of pins in the closed position.

Other features and advantages of the invention will be apparent from the following detailed description, taken in conjunction with the accompanying drawings which illustrate, by way of example, various features of embodiments of the invention.

BRIEF DESCRIPTION OF THE DRAWINGS

FIG. 4*a* provides perspective views of the swage tool in an unswaged position.

FIG. 4*b* provides perspective views of the swage tool in a swaged position.

DETAILED DESCRIPTION OF THE INVENTION

Figure 1:
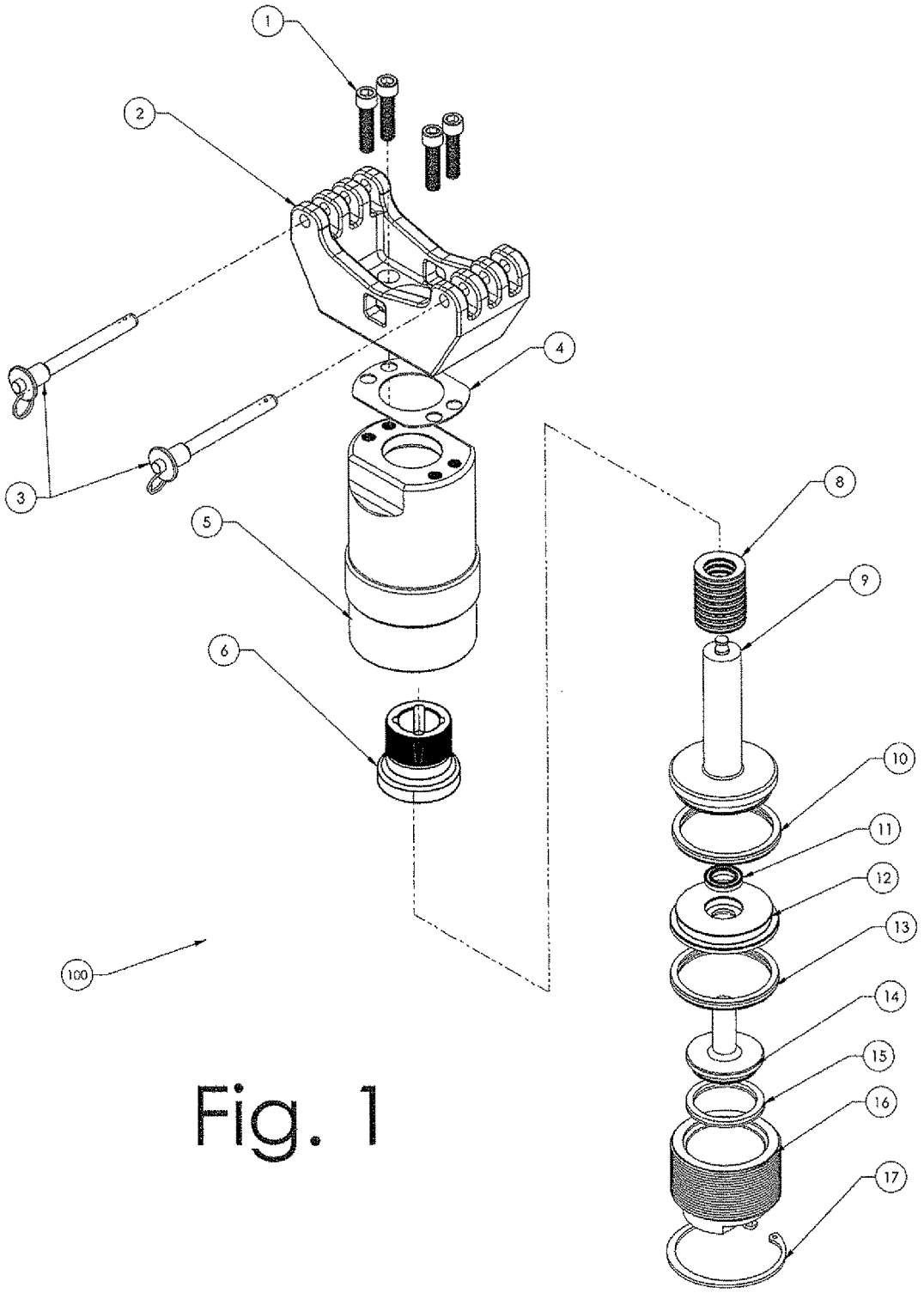
FIG. 1 is an exploded perspective view of a cylinder assembly portion of a swage tool according to the invention.

A pinned head swage tool is provided for swaging a fitting and joining tubes together. Cylinder 5 compresses a pair of dies 20 toward each other to swage a workpiece therebetween. Head 19 holds first die 20. Die block 21 holds second die 20. Each of the dies can include slots extending inwardly from either end to allow radial compression of the dies. The inventive swage tool is formed with head assembly portion 200 and cylinder assembly portion 100. FIG. 1 illustrates an exploded perspective view of a cylinder portion of a swage tool according to one embodiment of the invention. Die block holder 2 forms the uppermost portion of cylinder assembly portion 100 and is attached to cylinder 5 through bushing 4 and a set of socket screws 1. A pair of quick release pins 3 is provided for slidable insertion through corresponding holes in block holder 2 and head 19. On each side of die block holder 2 is a sawtooth portion that interlocks with a corresponding sawtooth portion in head 19. In FIG. 1, the sawtooth portion is formed with two sets of four teeth, while head 19 has two sets of three teeth. Each tooth has a hole for sliding insertion of a corresponding pin 3.

Puck (threaded insert) 6 is placed through a central hole within the uppermost portion of cylinder 5 and block holder 2 so as to protrude out from cylinder 5. As shown in the cross-sectional view in FIG. 3*a*, puck 6 makes contact with both block holder 2 and cylinder 5. Puck 6 is threaded on its exterior so as to secure die block holder 2 to cylinder 5. Snap rings are conventionally used in place of threaded insert 6. However, the use of the snap rings in the cylinder leads to wear and degradation in the cylinder that over time, requires replacement of the entire unit. By contrast, threaded insert 6 is an expendable part that can be removed and replaced without replacing the whole unit. Thus, maintenance costs are reduced.

Disc springs 8 are provided below puck 6 within cylinder 5. Disc spring 8 compresses and expands based on the movement of upper piston 9 and is provided between puck 6 and upper piston 9. The use of a disc spring advantageously reduces the size, and thereby reduces the weight, of the cylinder over swage tools using conventional helix springs.

Figure 3A:
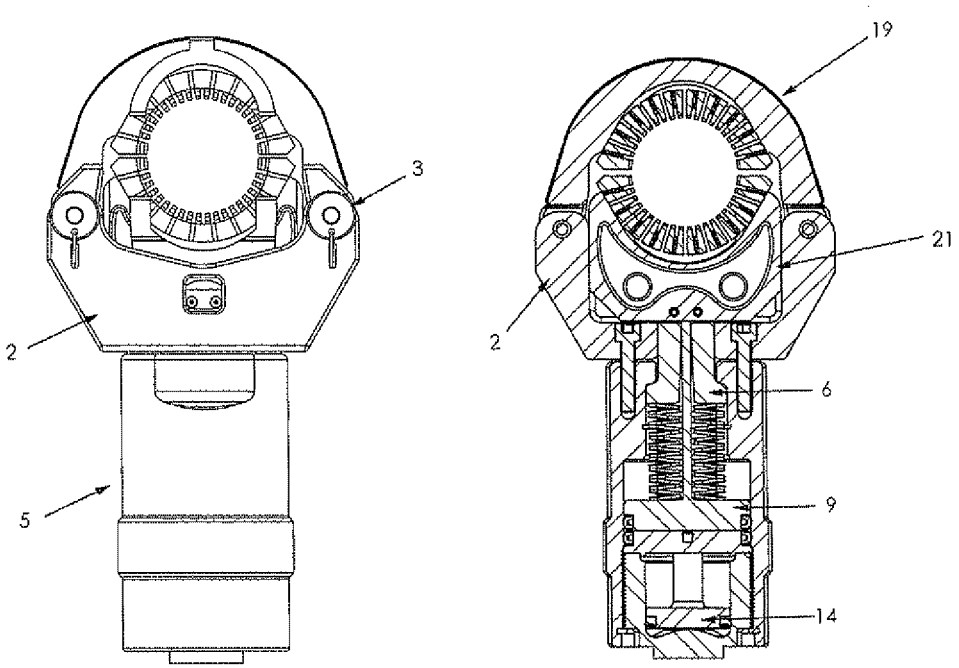
FIG. 3*a* is a side and cross-sectional view of the swage tool in an unswaged position.
Figure 3B:
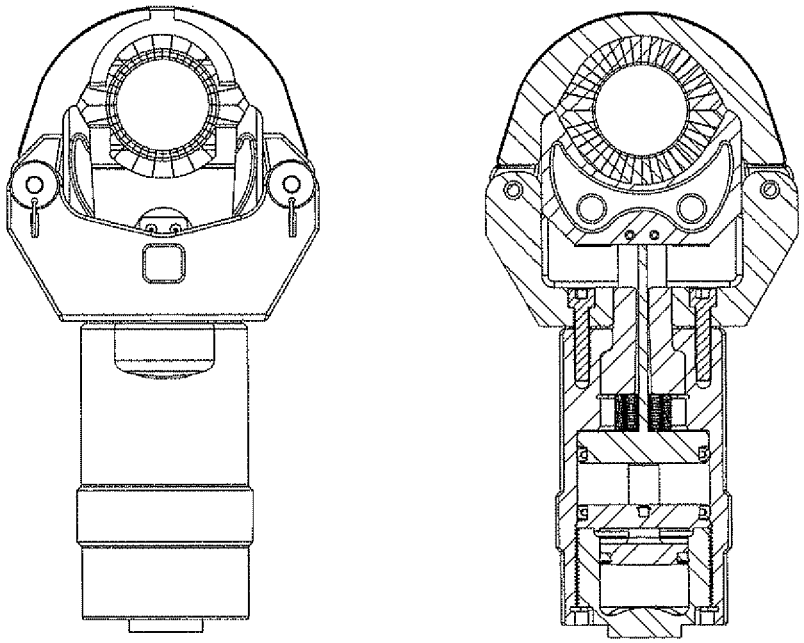
FIG. 3*b* is a side and cross-sectional view of the swage tool in a swaged position.

Upper piston 9 is slid through the center of spring 8 and a hole in puck 6 in order to couple with and push up die block 21 between unswaged and swaged positions (FIGS. 3*a* and 3*b*). Upper piston 9 includes on its bottom surface upper piston seal 10. Cylinder 5 is divided into upper and lower chambers by divider 12. In particular, upper piston 9 is a rod that slidably extends through the bore of the cylinder for connection to die block 21. Lower piston 14 moves within the lower chamber and slidably extends through a bore in divider 12 so as to abut upper piston 9. The two pistons are biased to a retracted position by disc springs 8. The pair of pistons within the cylinder moves the lower die towards the upper die to swage the workpiece. This double piston configuration provides enhanced force for swaging.

At an unswaged position (FIG. 3*a*), upper piston 9 sits above divider 12. Divider 12 is formed with seal rod 11 and divider seal 13 where seal rod 11 sits within a hole of divider 12 and divider seal 13 is provided around a circumference of divider 12 (FIG. 1). Threaded bottom cap 16 is provided below divider 12 and is screwed into the bottom of cylinder 5. Bottom cap 16 includes retaining ring 17 and houses within it lower piston 14. Lower piston 14 includes lower piston seal 15 and moves up and down through a hole in divider 12 to move upper piston 9, which in turn moves the dies closer together.

Figure 2:
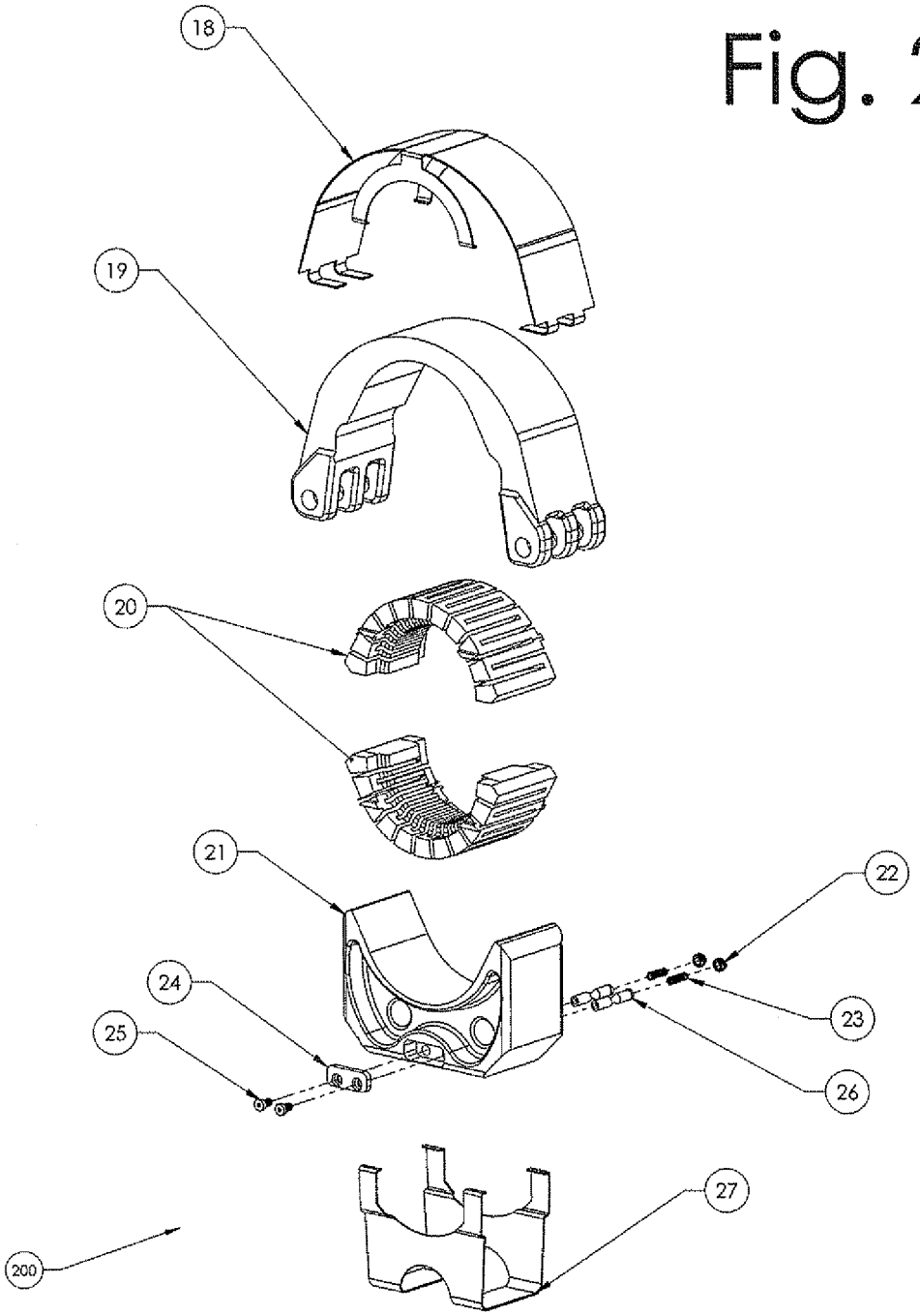
FIG. 2 is an exploded perspective view of a head assembly portion of a swage tool.

Next, head assembly portion 200 illustrated in FIG. 2 will be described in detail. Lower retaining clip 27 is attached underneath die block 21 and retains the lower half of swage die 20 to die block 21 using tabbed portions of clip 27. Likewise, substantially U-shaped head 19 is provided with upper retaining clip 18 attached above head 19 in order to retain the upper half of swage die 20 to head 19 via tabbed portions of clip 18. A set of tabs also secures clip 18 to head 19. In this manner, the first and second dies are coupled to head 19 and die block 21, respectively. The tabbed clips allow the swage dies to be easily and quickly replaced without specialized tools and also increases safety by protecting a user in case of a fracture during swaging.

Figure 5:
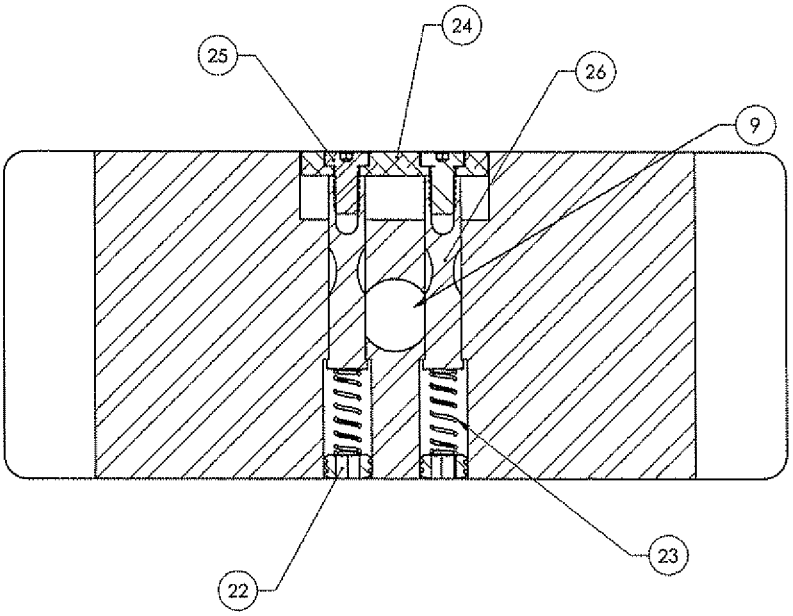
FIG. 5 is a cross-sectional plan view of the connecting portion of the die block.

Die block 21 includes a connecting portion to provide attachment of cylinder assembly portion 100 to head assembly portion 200. The connecting portion includes elements 22-26 as well as an interior cavity within die block 21 that can accommodate the insertion of a portion of upper piston 9 of cylinder assembly portion 100. The connecting portion is provided on an underside of die block 21 opposite from the lower half of die 20. FIG. 5 is a cross-sectional plan view of the connecting portion of die block 21. A set of push pins 26 are moved between open and closed positions. The closed position is shown in FIG. 5. Screws 25 connect push plate 24 to push pins 26. Springs 23 are provided between pins 26 and set screws 22. Push pins 26 and springs 23 are secured within die block 21 on one side by push plate 24 and screws 25, and on the opposite side with set screws 22. A pair of set screws 22 secures the connecting portion within die block 21.

When a user applies force to push plate 24, push pins 26 are moved towards screws 22 to allow insertion of piston 9 into block 21. For example, push pins 26 include indentations that are sized to allow the tip of upper piston 9 to be inserted when pins 26 are pushed towards screws 22. In FIG. 5, pins 26 include a set of semi-circular indentations that match the circumference of the tip of upper piston 9. If the connecting portion is in the closed position, the piston will not pass through the pins and therefore will not be coupled to the die block. However, in the open position, the gap between pins 26 will be just wide enough to allow insertion of piston 9 into the interior cavity of die block 21. Once inserted, releasing push plate 24 moves the push pins to a closed position where piston 9 cannot fall out of die block 21.

The process of assembling the swage tool will be described below. At rest, the connecting portion is provided in the closed position where push plate 24 is flush with the exterior of die block 21. An open position is formed after a user pushes in push plate 24. While maintaining the open position, the user is able to slide the tip of upper piston 9 between the indentations of push pins 26 and slide piston 9 up into an interior space of die block 2. When the user releases pressure on push plate 24, push pins 26 slide back into the closed position and lock upper piston 9 to die block 21. Piston 9 is secured between the set of pins 26 in the closed position. In this manner, a user is able to attach and separate head assembly portion 100 from cylinder assembly portion 200 quickly and without the need for specialized tools or complex parts. The open position allows insertion of the cylinder into the die block and the closed position secures the inserted cylinder within the die block. As shown in FIGS. 1 and 3*a*, a window is provided within block holder 2 for a user to press in push plate 24. Pin 3 may conveniently be used to apply force to push plate 24. When assembled, die block 21 is set within block holder 2 and attached to upper piston 9 through the connecting portion. An internal locking mechanism is thus provided to engage the upper piston and the die block. There are no outwardly protruding points in the connecting portion once assembled. The connecting portion of die block 21 securely attaches the cylinder to the die block.

Figure 6:
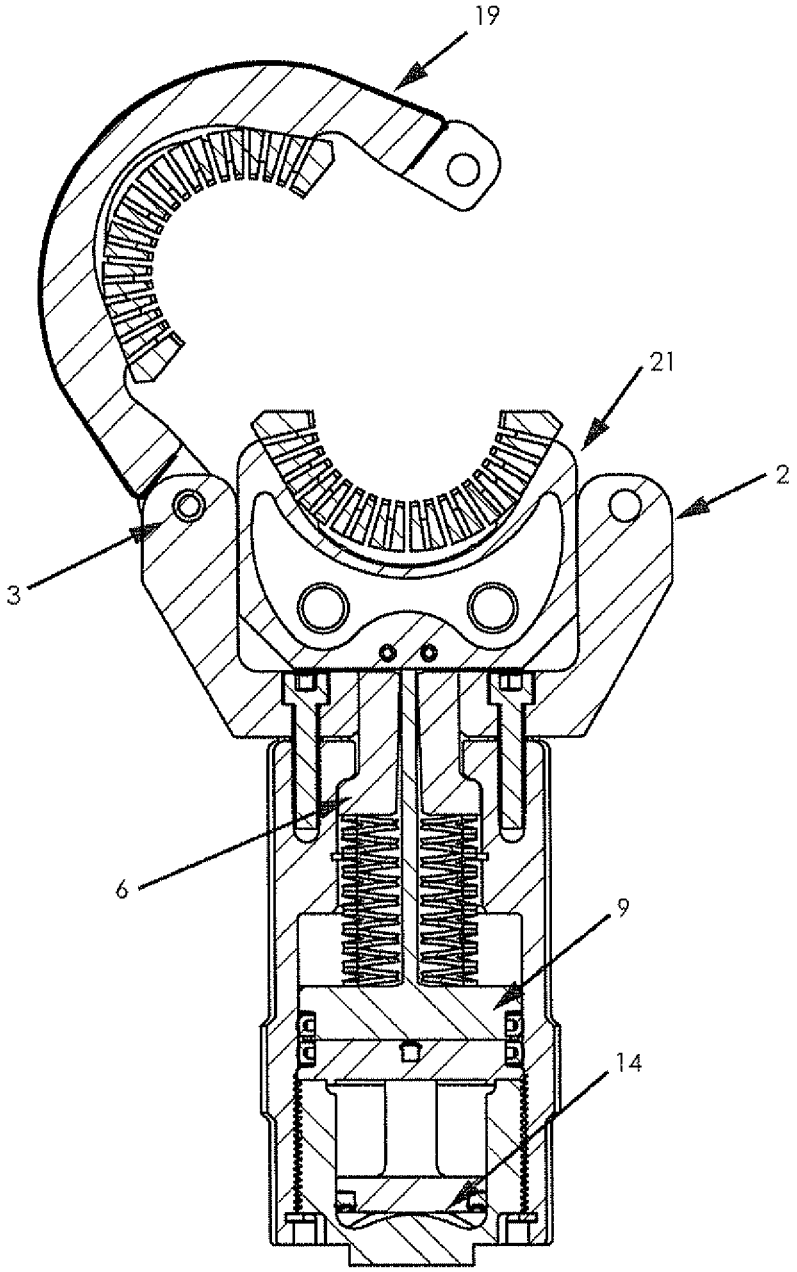
FIG. 6 is a cross-sectional view of the swage tool in a swung open position.

Next, head 19 is placed over block holder 2 in a manner that the sawtooth portions of head 19 interlock with the corresponding sawtooth portions of die block holder 2. Then, quick-release pins 3 can be inserted through the corresponding holes provided in both block holder 2 and head 19. Pins 3 ensure that head 19 and block holder 2 are securely attached to each other during swaging operation. If only one pin 3 is inserted into block holder 2 and head 19, then head 19 can swing open easily about inserted pin 3 in order to accept or remove the workpiece to be swaged. FIG. 6 shows the swage tool where only one pin 3 is inserted into head 19 and die block holder 2. In this case, head 19 freely rotates about an axis of pin 3 that is transverse to a longitudinal axis of cylinder 5. The head can be swung about either pin hole, as desired, in order to improve ergonomics for users who are either right-handed or left-handed. This allows the swage tool and workpiece to be assembled with greater flexibility than conventional swage tools. The inserted pins prevent undesirable rotation and movement between the head and the cylinder while also providing a quick release, as opposed to a configuration where screws or threaded bolts are provided in place of the pins. Accordingly, the inventive pinned head swage tool advantageously allows objects to be quickly inserted and removed from a swage tool. The operator can also quickly determine if the swage tool is secured simply by examining the position of the pins. Although two pins are illustrated in the drawing figures, more than two pins may be utilized.

Once the workpiece is in place, head 19 can be swung closed on the other side of block holder 2, and second pin 3 can be inserted to secure the workpiece. FIG. 3*a* shows the configuration of both pins inserted so as to securely attach the head to the block holder. FIGS. 3*a* and 3*b* illustrate side views and cross-sectional views of the swage tool in unswaged and swaged positions. The workpiece is not shown for clarity. The unswaged position (FIG. 3*a*, 4*a*) is the configuration where pins 3 are secured through the corresponding holes in die block holder 2 and head 19 and where spring 8 is uncompressed and die block 21 rests on block holder 2. The swaged position (FIG. 3*b*, 4*b*) is the configuration where pistons 9 and 14 are pushed upwards to compress spring 8 and raise die block 21 such that the upper and lower portions of swage die 20 are brought closer together. FIGS. 4*a* and 4*b* provide corresponding perspective views of the unswaged and swaged positions.

In another embodiment of swage tool assembly, the first die is coupled to head 19. The second die is coupled to die block 21. In particular, first clip 18 couples the first die to head 19 and second clip 27 couples the second die to die block 21. After assembling the die block onto the die block holder, cylinder 5 is coupled to die block 21, as described above. Once the pressure on push plate 24 is released, the force of spring 23 allows the connecting portion to return to the closed position to secure the cylinder to the die block.

Next, first pin 3 is slid through respective holes in sawtooth portions of head 19 and die block holder 2. When one pin is inserted, the head is rotatable about an axis transverse to a longitudinal axis of cylinder 5. A second pin is then slid through the head and the die block holder at another sawtooth portion opposite from the first pin. Head 19 is secured to die block holder 2 after sliding in the first and second pins. A workpiece may be placed onto the swage die before or after the first pin is inserted. A workpiece to be swaged is positioned on top of lower die 20. The user can visually check the pins to ensure that they fully secure the swage tool. After the workpiece is set in place, pressurized fluid enters cylinder 5. This action moves the pistons upward and compresses the workpiece between the dies. When the fluid pressure is released and disc spring 8 moves the pistons to their retracted positions, the workpiece is removed from the swage tool and the swaging operation is complete.

The invention provides a swage tool that is versatile and compact in design and further allows insertion of a workpiece in multiple ways. The invention is also simple to operate, reliable and easy to service. The swage tool ensures proper connection, alignment and orientation of the upper die with the lower die and provides superior ease of use and assembly. The tool is also much lighter and smaller than conventional swage tools and can be replaced in a more modular fashion to reduce long-term costs. For example, the inventive swage tool is approximately 15% lighter in weight than conventional swage tools. Assembling is made easier using the connecting portion and the quick release pins such that the number of people necessary to operate the tool is reduced.

The embodiments of the invention described in this document are illustrative and not restrictive. Modification may be made without departing from the spirit of the invention as defined by the following claims.

The invention claimed is:

1. A swage tool, comprising:

a head;

a die block;

a first die coupled to a portion of the head;

a second die coupled to a portion of the die block;

a die block holder holding the die block and the second die;

a cylinder that moves the second die toward the first die; and a connecting portion extending through the die block, wherein the connecting portion includes a set of push pins movable between an open position that allows insertion of the cylinder into the die block and a closed position that secures the inserted cylinder within the die block, and a push plate that connects the set of push pins on one side of the die block, wherein the outer surface of the push plate is flush with an exterior of the die block in the closed position and the push plate is configured to be received into a window disposed in the die block in the open position.

2. The swage tool according to claim 1, wherein the cylinder includes a first piston that is configured to engage the die block and that is coupled to the connecting portion, and a second piston that is configured to engage the first piston.

3. The swage tool according to claim 1, wherein the connecting portion includes a spring.

4. The swage tool according to claim 1, wherein the connecting portion is provided on a side of the die block opposite the second die.

5. The swage tool according to claim 1, wherein the cylinder is secured between the set of pins in the closed position.

6. A method of assembling a swage tool, comprising the steps of:

coupling a first die to a head;

coupling a second die to a die block;

coupling the head to a die block holder; and coupling a cylinder to the die block by:

pressing in a connecting portion of the die block into an open position that allows insertion of the cylinder into the die block;

maintaining the open position while inserting the cylinder into the die block; and releasing the connecting portion into a closed position that secures the cylinder within the die block, wherein the connecting portion includes a set of push pins that are movable between the open position and the closed position, and a push plate that connects the set of push pins on one side of the die block, the outer surface of the push plate is flush with an exterior of the die block in the closed position, and the push plate is configured to be received into a window disposed in the die block in the open position.

7. The method of assembling according to claim 6, wherein the cylinder includes a first piston that is configured to engage the die block and that is coupled to the connecting portion, and a second piston that is configured to engage the first piston.

8. The method of assembling according to claim 6, wherein the connecting portion includes a spring.

9. The method of assembling according to claim 6, wherein the connecting portion is provided on a side of the die block opposite the second die.

10. The method of assembling according to claim 6, wherein the cylinder is secured between the set of pins in the closed position.

* * * * *